US008517774B2

(12) United States Patent
Kumamoto et al.

(10) Patent No.: US 8,517,774 B2
(45) Date of Patent: Aug. 27, 2013

(54) CONNECTOR WITH GROUND ELECTRODE TERMINALS HAVING DIFFERENT LENGTHS

(75) Inventors: Tadashi Kumamoto, Tokyo (JP); Takeshi Okuyama, Tokyo (JP); Kazuhiro Mizukami, Tokyo (JP); Toshihiro Kusagaya, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 195 days.

(21) Appl. No.: 13/149,359

(22) Filed: May 31, 2011

(65) Prior Publication Data

US 2011/0306248 A1 Dec. 15, 2011

(30) Foreign Application Priority Data

Jun. 11, 2010 (JP) ..... 2010-134028

(51) Int. Cl.
*H01R 24/00* (2011.01)

(52) U.S. Cl.
USPC ..... 439/660; 439/607.08

(58) Field of Classification Search
USPC ..... 439/660, 607.05, 607.06, 607.07, 439/607.08, 607.1, 607.11
See application file for complete search history.

(56) References Cited

U.S. PATENT DOCUMENTS

| | | | | |
|---|---|---|---|---|
| 5,238,414 | A * | 8/1993 | Yaegashi et al. | 439/108 |
| 6,280,209 | B1 | 8/2001 | Bassler et al. | |
| 6,439,928 | B1 * | 8/2002 | Akama et al. | 439/607.09 |
| 6,500,029 | B2 * | 12/2002 | Nitta | 439/607.11 |
| 7,488,188 | B2 * | 2/2009 | Moriyama et al. | 439/108 |
| 7,604,510 | B2 * | 10/2009 | Akama et al. | 439/637 |
| 8,007,316 | B2 * | 8/2011 | Costello | 439/607.1 |
| 8,047,875 | B2 * | 11/2011 | Yamakami et al. | 439/660 |
| 2006/0019545 | A1 * | 1/2006 | Moriyama et al. | 439/660 |
| 2010/0190385 | A1 * | 7/2010 | Yamakami et al. | 439/700 |
| 2012/0135615 | A1 * | 5/2012 | Mizukami et al. | 439/108 |

FOREIGN PATENT DOCUMENTS

JP 2005-005272 1/2005

* cited by examiner

*Primary Examiner* — Hae Moon Hyeon
(74) *Attorney, Agent, or Firm* — IPUSA, PLLC

(57) ABSTRACT

A connector includes a plug connector and a jack connector configured to be connected with the plug connector. The plug connector includes a plug ground electrode, and a pair of plug terminals configured to transmit electric signals and having plug terminal connecting parts formed at first ends of the plug terminals. The jack connector includes a jack ground electrode, and a pair of jack terminals configured to transmit electric signals and having jack terminal connecting parts formed at first ends of the jack terminals. The jack terminal connecting parts are configured to be inserted between the plug terminal connecting parts and brought into contact with opposing surfaces of the plug terminal connecting parts when the jack connector is connected with the plug connector.

15 Claims, 23 Drawing Sheets

CONNECTOR WITH GROUND ELECTRODE TERMINALS HAVING DIFFERENT LENGTHS

CROSS-REFERENCE TO RELATED APPLICATION

This application is based upon and claims the benefit of priority of Japanese Patent Application No. 2010-134028 filed on Jun. 11, 2010, the entire contents of which are incorporated herein by reference.

FIELD

The embodiments discussed herein are related to a connector.

BACKGROUND

Connectors or connecting parts are used to electrically connect electronic devices and apparatuses and thereby to transmit electric signals between them. There are various types of connectors for different applications. For example, there are high-frequency connectors for transmission of high-frequency signals.

Japanese Laid-Open Patent Publication No. 2005-005272, for example, discloses a high-frequency connector for high-speed data transmission that is configured to minimize the discontinuity of the impedance through the connector.

Here, a high-frequency signal is relatively easily affected by noise. Particularly in a high-frequency connector, a change in the positional relationship between a ground (GND) terminal and a signal terminal affects the characteristic impedance at the signal terminal. This in turn degrades or causes a loss of a transmitted signal and causes a negative effect on high-speed signal transmission. Meanwhile, a high-frequency connector generally includes multiple connecting terminals to improve the transmission rate. For this reason, it is desired to arrange the connecting terminals as densely as possible in a connector while reducing the size of the connector.

SUMMARY

According to an aspect of the invention, there is provided a connector including a plug connector and a jack connector configured to be connected with the plug connector. The plug connector includes a plug ground electrode, and a pair of plug terminals configured to transmit electric signals and having plug terminal connecting parts formed at first ends of the plug terminals. The jack connector includes a jack ground electrode, and a pair of jack terminals configured to transmit electric signals and having jack terminal connecting parts formed at first ends of the jack terminals. The jack terminal connecting parts are configured to be inserted between the plug terminal connecting parts and brought into contact with opposing surfaces of the plug terminal connecting parts when the jack connector is connected with the plug connector.

It is to be understood that both the foregoing general description and the followed detailed description are exemplary and explanatory and are not restrictive of the invention as claimed.

DESCRIPTION OF EMBODIMENTS

Preferred embodiments of the present invention are described below with reference to the accompanying drawings.

First Embodiment (Connector)

Figure 1A:
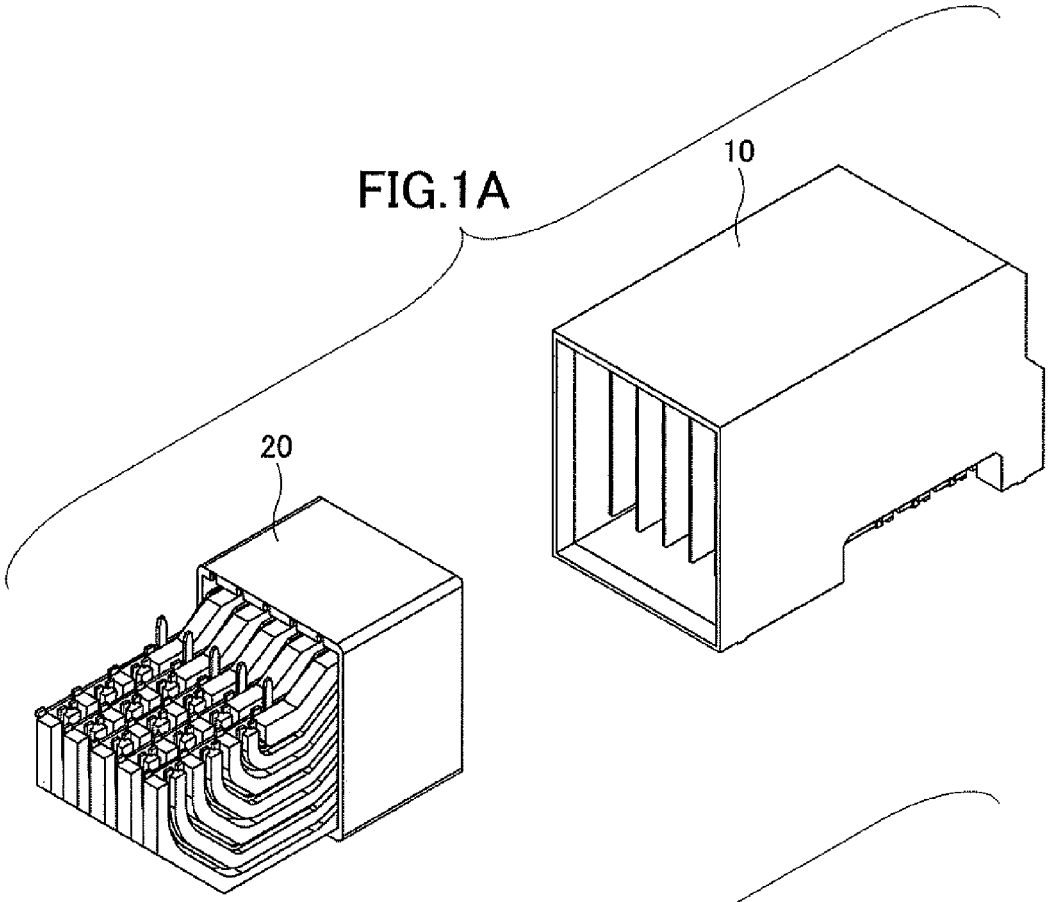
FIG. 1A is a top perspective view of a connector according to a first embodiment.
Figure 1B:
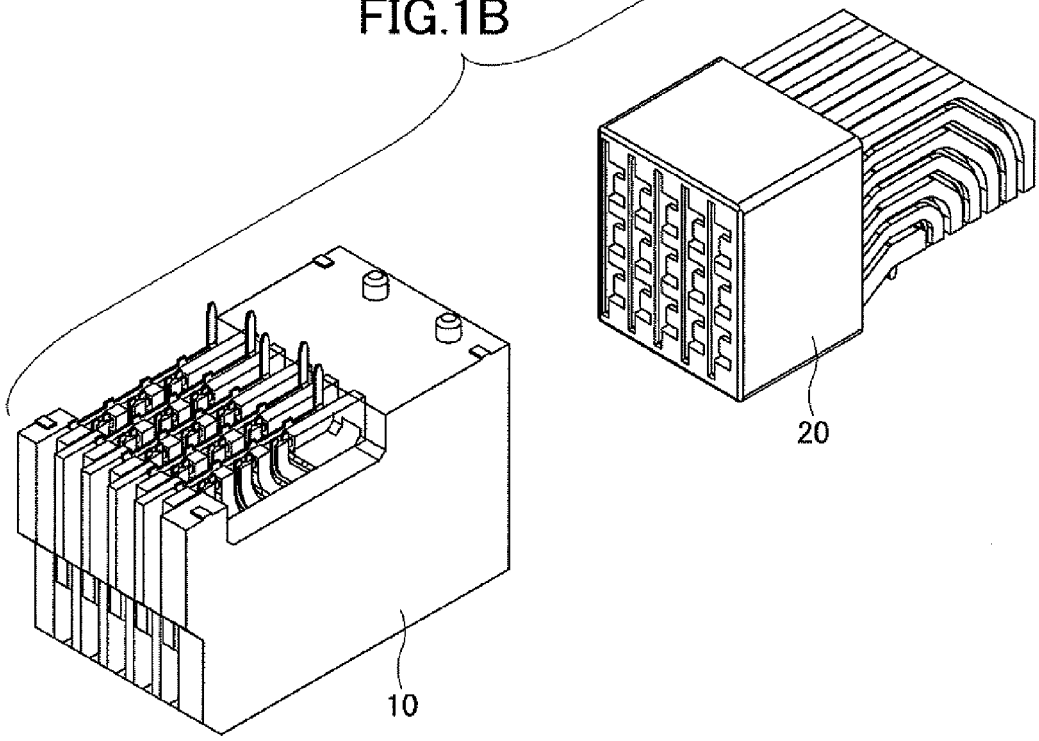
FIG. 1B is a bottom perspective view of the connector of the first embodiment.

A connector according to a first embodiment of the present invention is described below. The connector of the first embodiment is, for example, a high-frequency connector capable of connecting electronic devices and transmitting electric signals at high speed. As illustrated in FIGS. 1A and 1B, the connector includes a plug connector 10 and a jack connector 20 that are to be connected to each other.

FIG. 1A is a top perspective view of the plug connector 10 and the jack connector 20, and FIG. 1B is a bottom perspective view of the plug connector 10 and the jack connector 20.

(Plug Connector)

Figure 2:
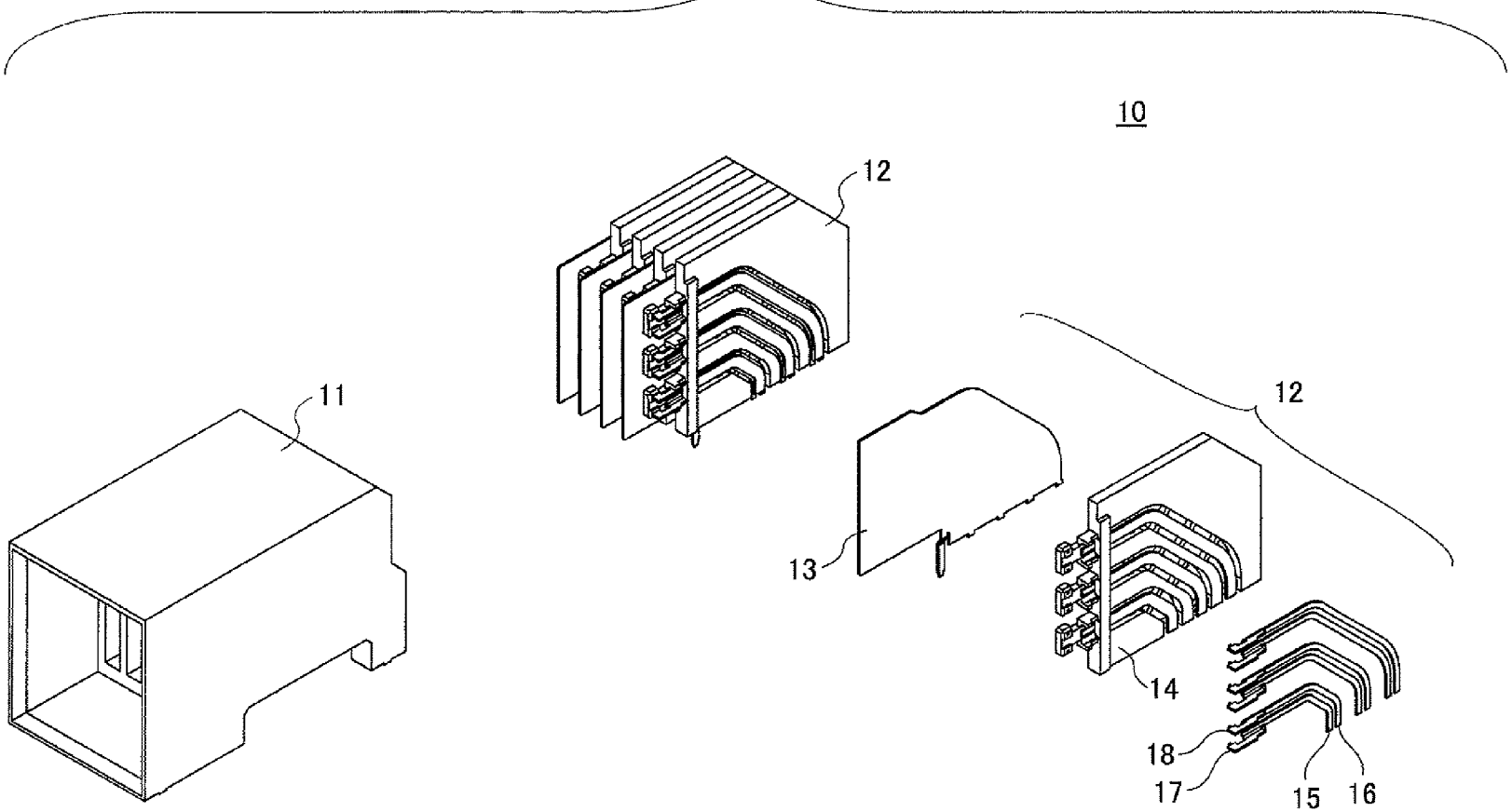
FIG. 2 is a drawing illustrating components of a plug connector according to the first embodiment.

As illustrated in FIG. 2, the plug connector 10 may include a housing 11 and multiple plug units 12. Each of the plug units 12 may include a ground (GND) part (plug ground electrode) 13 made of, for example, a metal plate; an insulating part 14 made of, for example, a resin material; and pairs of plug terminals 15 and 16 used as electrode terminals. The pairs of the plug terminals 15 and 16 may transmit different electric signals. In the example of FIG. 2, three pairs of the plug terminals 15 and 16 are provided. The plug terminals 15 and 16 are insulated from the GND part 13 by the insulating part 14. Plug terminal connecting parts 17 and 18 are formed at first ends of the plug terminals 15 and 16. The plug terminal connecting parts 17 and 18 may be shaped like bars and are to be connected with jack terminals 25 and 26 (see FIG. 3). Electrode terminals (not shown) to be connected with a (circuit) board 19 (see FIG. 12) are formed at second ends of the plug terminals 15 and 16.

(Jack Connector)

Figure 3:
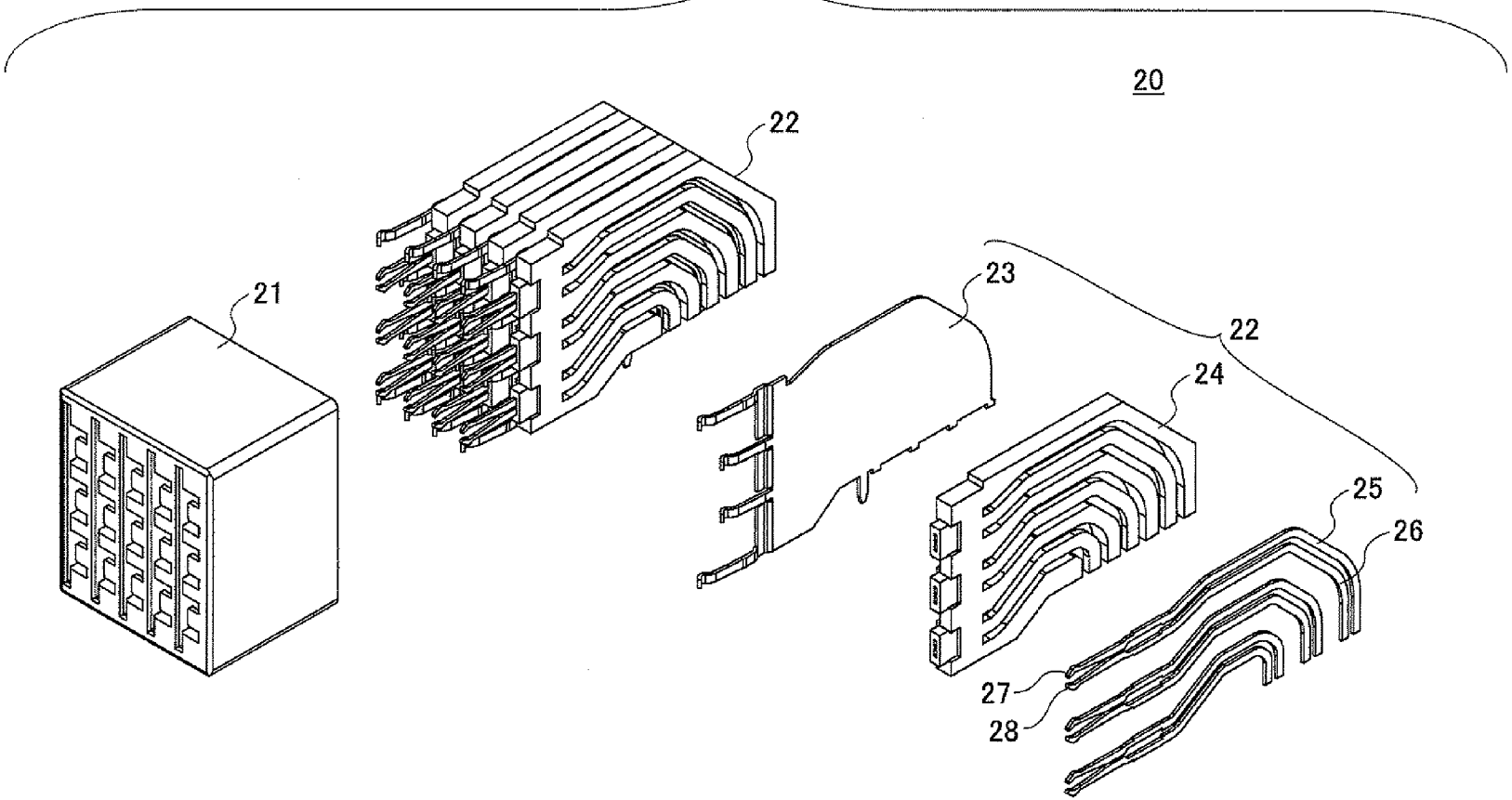
FIG. 3 is a drawing illustrating components of a jack connector according to the first embodiment.

As illustrated in FIG. 3, the jack connector 20 may include a housing 21 and multiple jack units 22. Each of the jack units 22 may include a ground (GND) part (jack ground electrode) 23 made of, for example, a metal plate; an insulating part 24 made of, for example, a resin material; and pairs of jack terminals 25 and 26 used as electrode terminals. The pairs of the jack terminals 25 and 26 may transmit different electric signals. In the example of FIG. 3, three pairs of the jack terminals 25 and 26 are provided. The jack terminals 25 and 26 are insulated from the GND part 23 by the insulating part 24. Jack terminal connecting parts 27 and 28 are formed at first ends of the jack terminals 25 and 26. The jack terminal connecting parts 27 and 28 may be shaped like bars and are to be connected with the plug terminal connecting parts 17 and 18 of the plug terminals 15 and 16. Electrode terminals (not shown) to be connected with a (circuit) board 29 (see FIG. 12) are formed at second ends of the jack terminals 25 and 26.

(Jack Unit)

Figure 4:
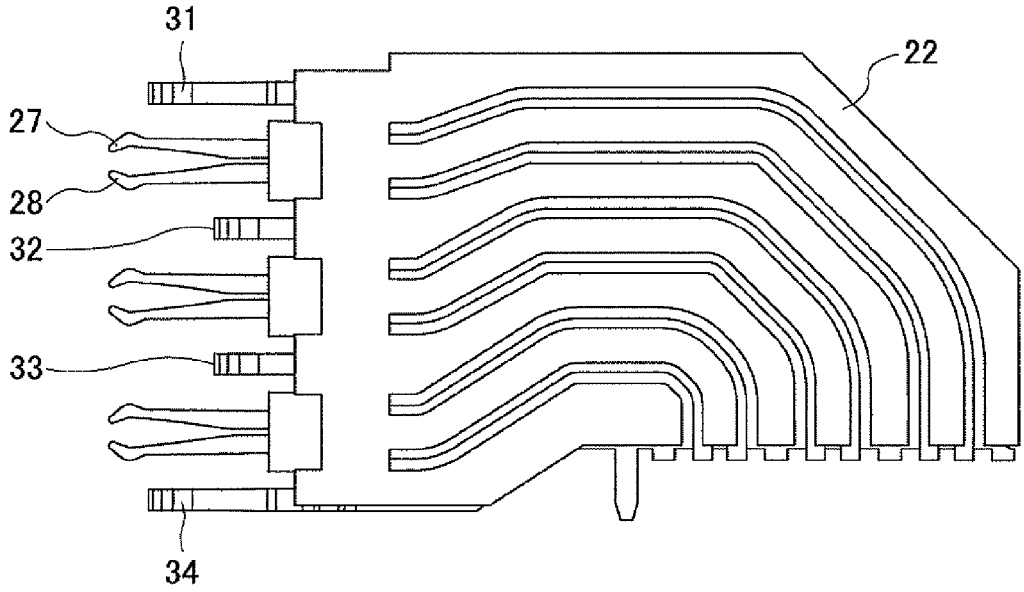
FIG. 4 is a top view of a jack unit of the first embodiment.
Figure 5:
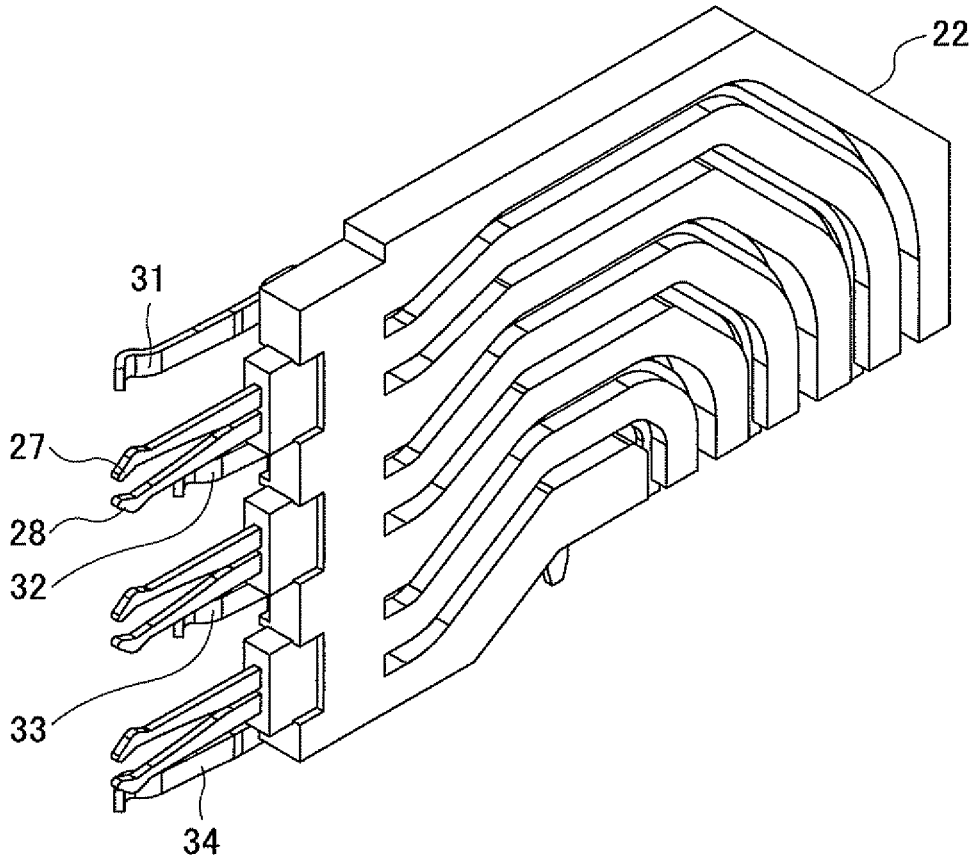
FIG. 5 is a perspective view of the jack unit of the first embodiment.
Figure 6:
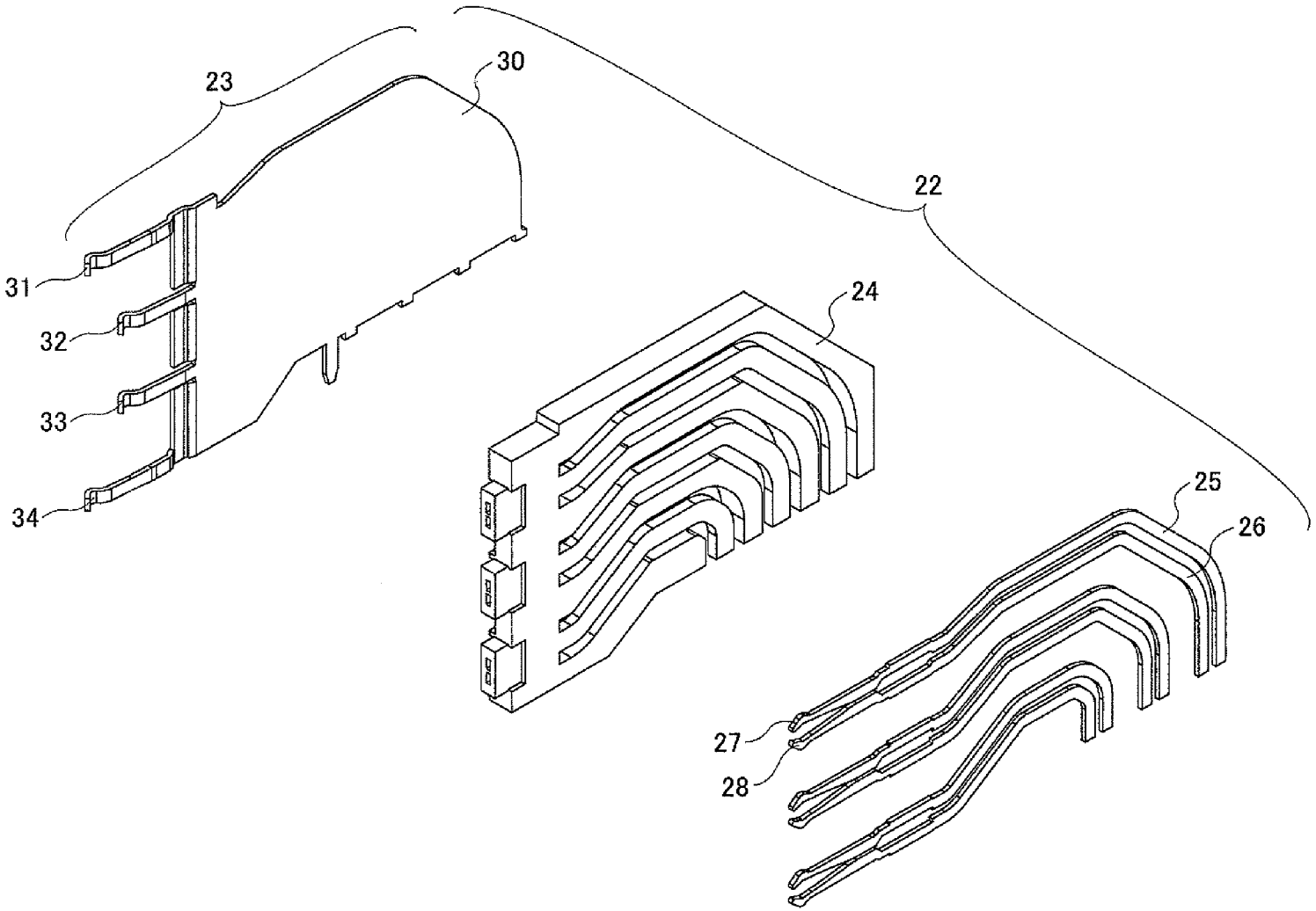
FIG. 6 is a drawing illustrating components of the jack unit of the first embodiment.

Next, the jack unit 22 is described in more detail with reference to FIGS. 4 through 6. The GND part 23 of the jack unit 22 may include a plate-like GND main part 30 and GND terminals 31, 32, 33, and 34 connected with the GND main part 30. The GND terminals 31 and 34 are disposed at outer positions (at edges of the GND main part 30) and longer than the GND terminals 32 and 33 that are disposed between the GND terminals 31 and 34.

The GND terminals 31 and 34 are made longer than the GND terminals 32 and 33 so that the GND part 13 of the plug connector 10 and the GND part 23 of the jack connector 20 are electrically connected to each other before the other parts are connected. This in turn makes it possible to prevent a device from being damaged by, for example, static electricity. Thus, with the above configuration, the GND part 13 of the plug connector 10 and the GND terminals 31 and 34 of the jack connector 20 are initially connected to each other.

When the plug connector 10 is connected with the jack connector 20, the GND terminals 31 through 34 of the jack connector 20 are connected to the GND part 13 of the plug connector 10. Here, making the GND terminals 32 and 33 shorter than the GND terminals 31 and 34 makes it possible to reduce (or narrow) a stub (an area where no current flows) on the GND part 13.

Figure 7:
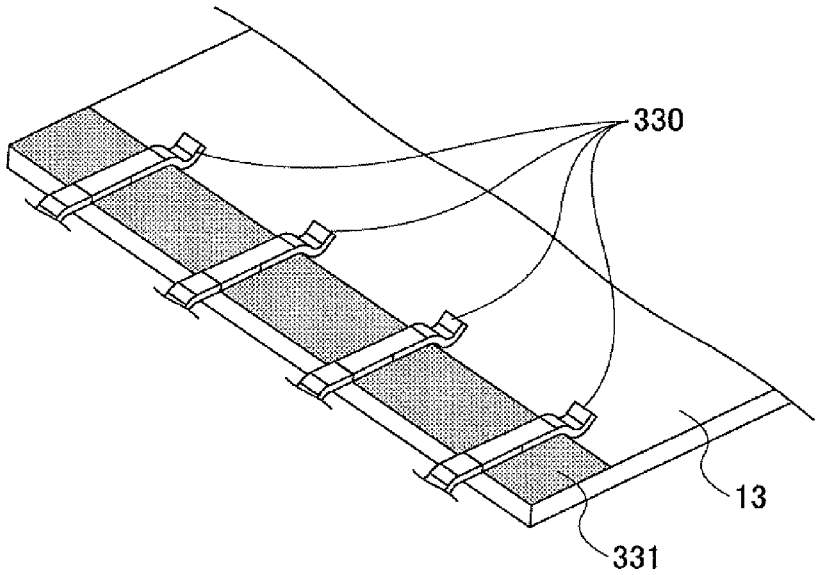
FIG. 7 is a first drawing used to describe a stub.
Figure 8:
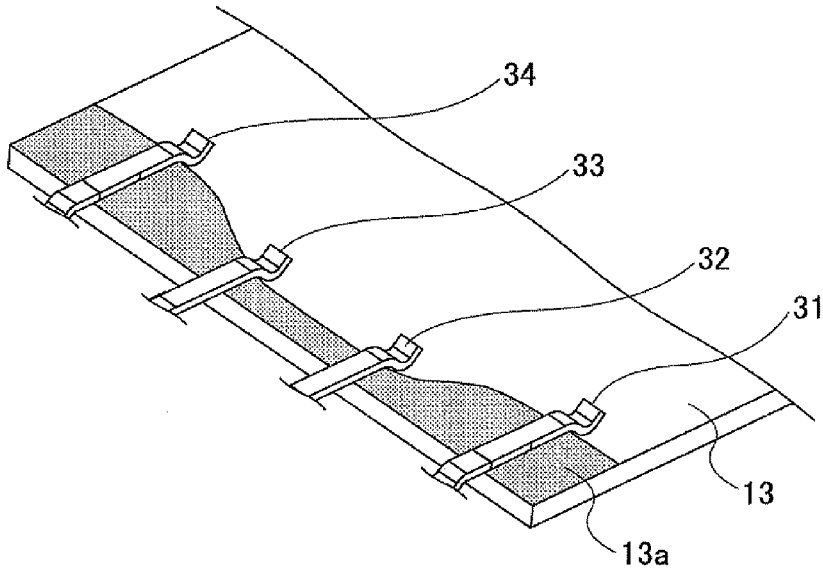
FIG. 8 is a second drawing used to describe a stub.

FIG. 7 is a drawing used to describe a stub in a comparative example. In FIG. 7, GND terminals 330 to be connected with the plug connector 10 have substantially the same length. In this case, a stub 331 (an area where no current flows) on the GND part 13 of the plug connector 10 becomes wide (or large). The electric potential in the stub 331 of the GND part 13 is unstable and does not necessarily correspond to the ground (GND) potential. Therefore, a stub is preferably reduced to reduce noise and to prevent a loss of a transmitted signal. In this embodiment, the GND terminals 32 and 33 are shorter than the GND terminals 31 and 34. With this configuration, as illustrated in FIG. 8, a stub 13*a* (an area where no current flows) becomes narrower (or smaller) than the stub 331 of the comparative example. As an alternative to the configuration of FIG. 8, long and short GND terminals may be arranged alternately.

Figure 9:
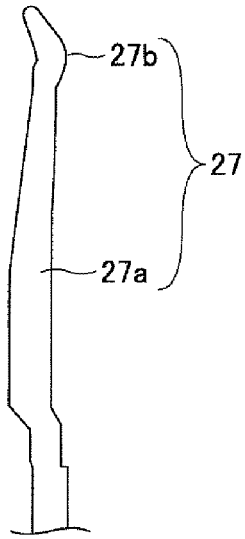
FIG. 9 is a drawing illustrating a jack terminal connecting part of the first embodiment.

The jack terminals 25 and 26 of the jack connector 20 are described below. As illustrated in FIG. 9, the jack terminal connecting part 27 of the jack terminal 25 includes an elastic bar-shaped part 27*a*, and a contact part 27*b* that is formed at an end of the bar-shaped part 27*a* and to be brought into contact with the plug terminal connecting part 17. The jack terminal has a configuration similar to that of the jack terminal 25. The jack terminal connecting part 28 has a shape symmetrical to that of the jack terminal connecting part 27. Accordingly, similar to the jack terminal connecting part 27, the jack terminal connecting part 28 includes an elastic bar-shaped part 28*a* and a contact part 28*b* that is formed at an end of the bar-shaped part 28*a* and to be brought into contact with the plug terminal connecting part 18.

Figure 10:
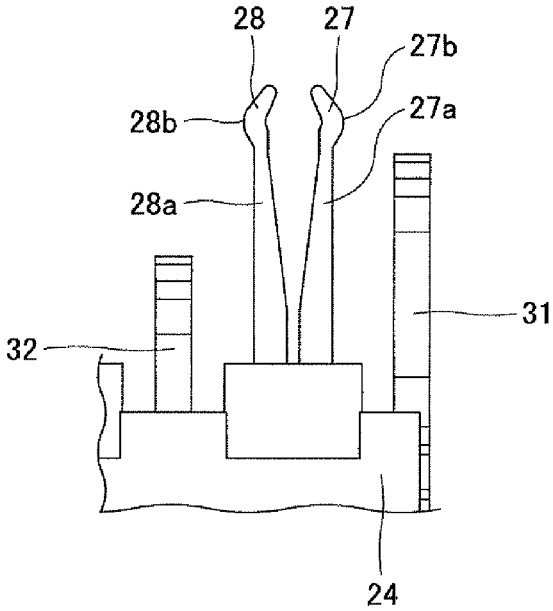
FIG. 10 is an enlarged view of a part of the jack unit of the first embodiment.
Figure 11:
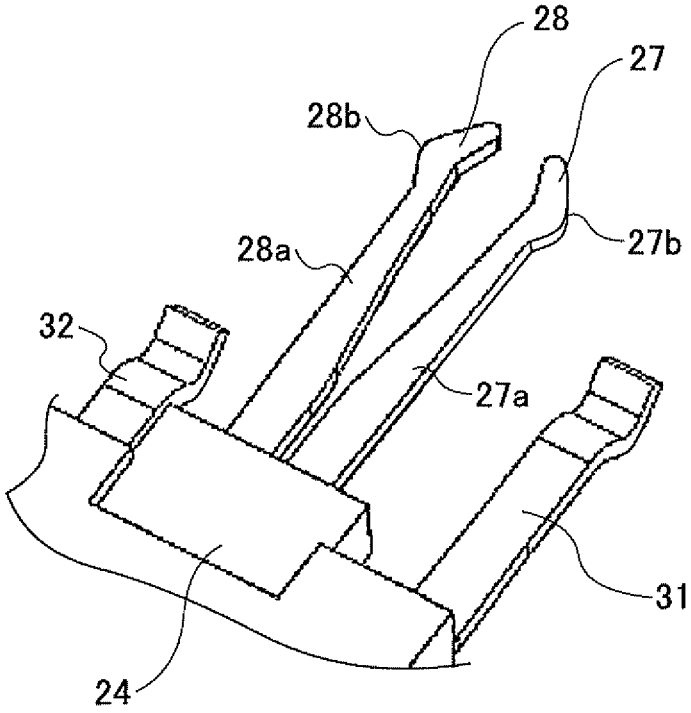
FIG. 11 is an enlarged view of a part of the jack unit of the first embodiment.

As illustrated in FIGS. 10 and 11, the jack terminal connecting parts 27 and 28 are disposed such that the contact parts 27*b* and 28*b* face outward. The elasticity of the bar-shaped parts 27*a* and 28*a* allows the distance between the contact parts 27*b* and 28*b* to change. In FIGS. 10 and 11, the jack terminal connecting parts 27 and 28 are disposed between the GND terminals 31 and 32. Similarly, other pairs of the jack terminal connecting parts 27 and 28 are disposed between the corresponding pairs of the GND terminals 32 through 34.

(Connecting Plug Connector and Jack Connector)

Figure 12:
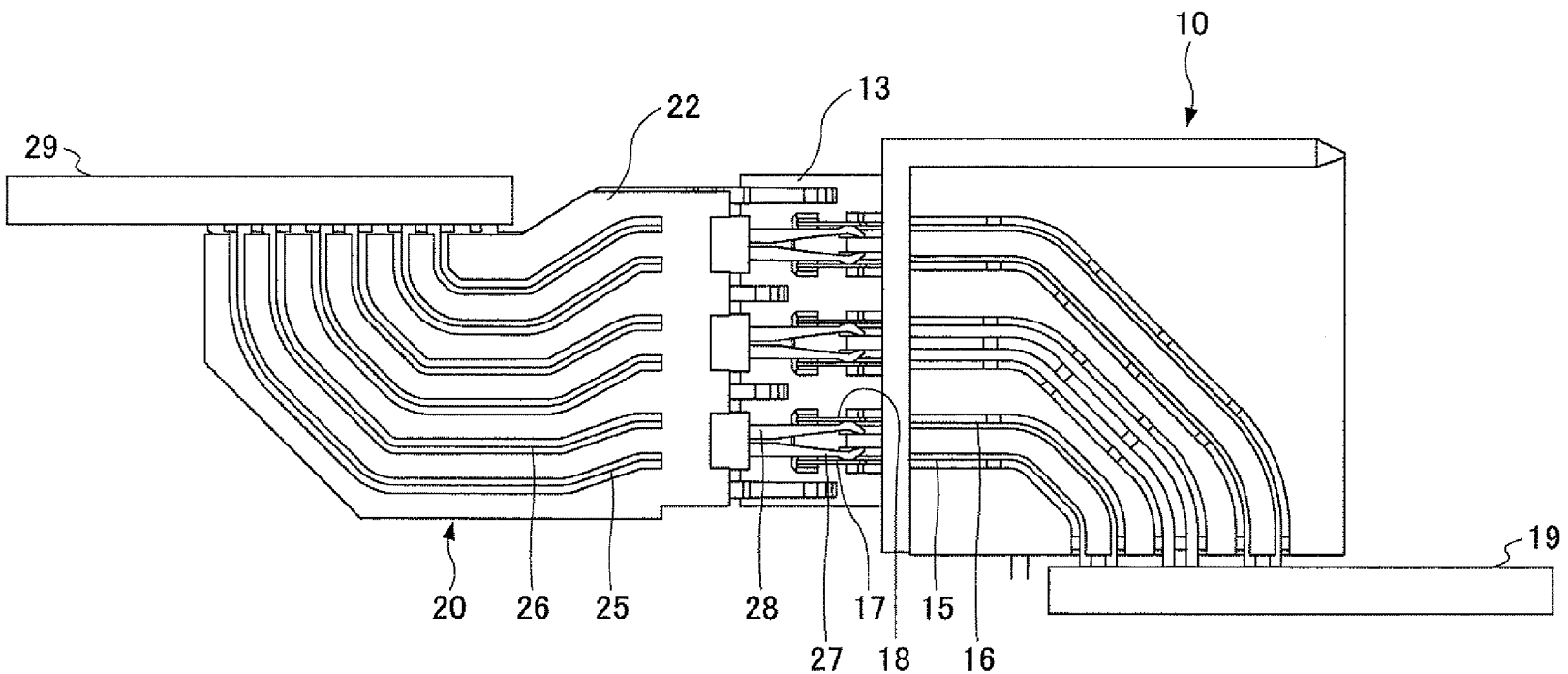
FIG. 12 is a drawing illustrating the plug connector and the jack connector of the first embodiment that are connected to each other.

FIG. 12 is a drawing illustrating the plug connector 10 and the jack connector 20 connected to each other. The board 19 is connected to the second ends (where the plug terminal connecting parts 17 and 18 are not formed) of the plug terminals 15 and 16 of the plug connector 10. As illustrated in FIG. 12, the board 19 faces a surface of the plug connector 10 that is orthogonal to a surface where the plug terminal connecting parts 17 and 18 are located. Also, GND terminals of the plug connector 10 are connected to the board 19 by, for example, soldering. The board 29 is connected to the second ends (where the jack terminal connecting parts 27 and 28 are not formed) of the jack terminals 25 and 26 of the jack connector 20. As illustrated in FIG. 12, the board 29 faces a surface of the jack connector 20 that is orthogonal to a surface where the jack terminal connecting parts 27 and 28 are located. Also, GND terminals of the jack connector 20 are connected to the board 29 by, for example, soldering.

Figure 13:
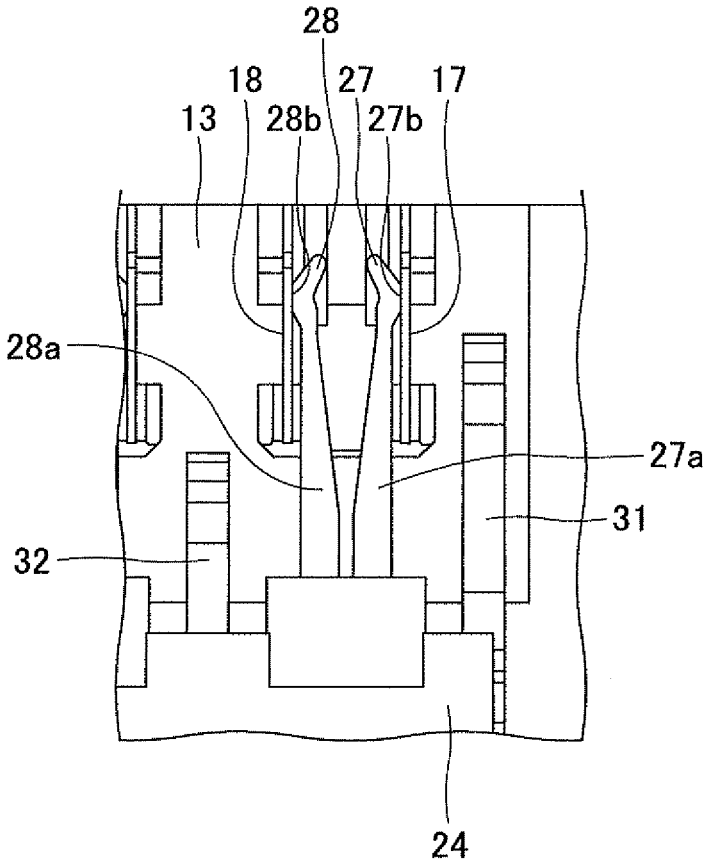
FIG. 13 is an enlarged view of a part of FIG. 12.
Figure 14:
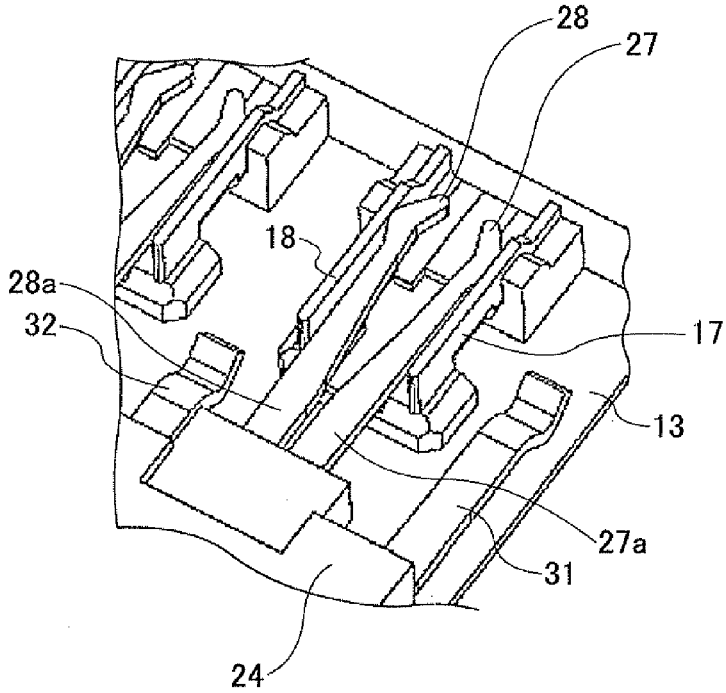
FIG. 14 is an enlarged view of a part of FIG. 12.

Referring to FIGS. 13 and 14, when the plug connector 10 and the jack connector 20 are connected to each other, the contact part 27*b* of the jack terminal connecting part 27 of the jack connector 20 is brought into contact with the plug terminal connecting part 17 of the plug connector 10, and the contact part 28*b* of the jack terminal connecting part 28 of the jack connector 20 is brought into contact with the plug terminal connecting part 18 of the plug connector 10. More specifically, when the plug connector 10 and the jack connector 20 are connected to each other, the contact parts 27*b* and 28*b* of each pair of the jack terminal connecting parts 27 and 28 are inserted between the corresponding pair of the plug terminal connecting parts 17 and 18 that face each other. As a result, the distance between the contact parts 27*b* and 28*b* is reduced by the plug terminal connecting parts 17 and 18 and due to the elasticity of the bar-shaped parts 27*a* and 28*a*, outward force is applied to the contact parts 27*b* and 28*b*. In other words, the contact parts 27*b* and 28*b* of the jack terminal connecting parts 27 and 28 are pressed against the inner surfaces (opposing surfaces) of the plug terminal connecting parts 17 and 18 due to the elasticity of the bar-shaped parts 27*a* and 28*a*. This configuration makes it possible to maintain the connection between the plug terminal connecting parts 17 and 18 and the jack terminal connecting parts 27 and 28. In connecting the plug connector 10 and the jack connector 20, the jack terminal connecting parts 27 and 28 of the jack connector 20 are moved along the plate-like GND part 13 of the plug connector 10. In other words, the jack connector 20 is configured to be connected with the plug connector 10 by moving the jack terminal connecting parts 27 and 28 substantially parallel to the plate-like GND part 13 of the plug connector 10. This configuration makes it possible to keep a constant distance between the jack terminal connecting parts 27 and 28 and the GND part 13.

Figure 15:
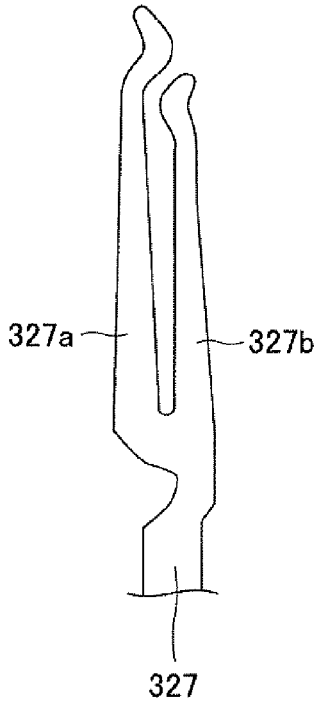
FIG. 15 is a drawing illustrating a jack terminal connecting part of a comparative example.
Figure 16:
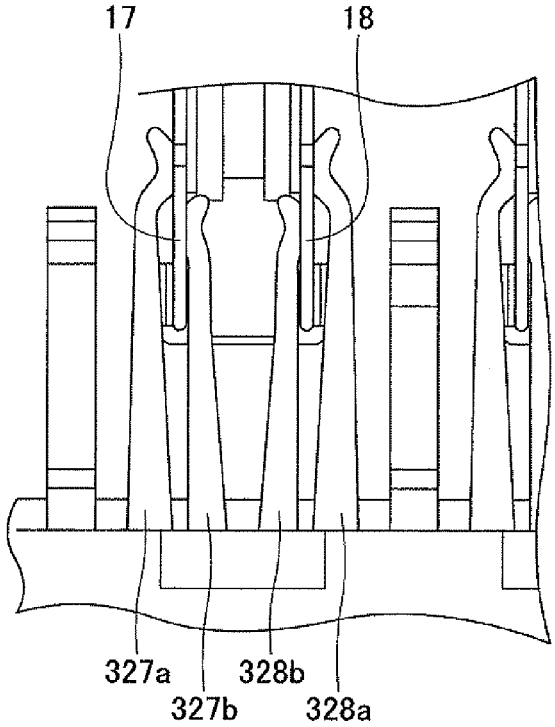
FIG. 16 is a drawing illustrating the jack terminal connecting part of the comparative example connected with a plug terminal connecting part.
Figure 17:
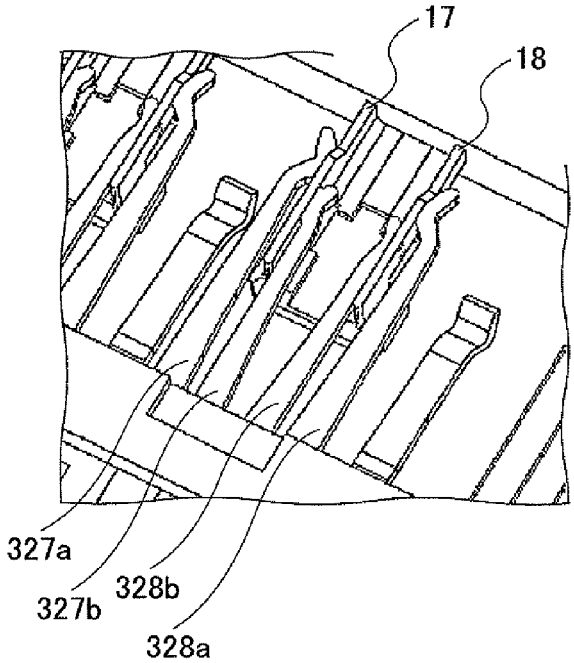
FIG. 17 is a drawing illustrating the jack terminal connecting part of the comparative example connected with a plug terminal connecting part.

FIGS. 15 through 17 are drawings illustrating jack terminal connecting parts 327 and 328 of a comparative example that are to be connected with the plug terminal connecting parts 17 and 18 of the plug connector 10. The jack terminal connecting part 327 includes terminal parts 327*a* and 327*b*, and the jack terminal connecting part 328 includes terminal parts 328*a* and 328*b*. Compared with the configuration of the comparative example, the configuration of this embodiment makes it possible to more densely arrange the jack terminal connecting parts 27 and 28 and thereby to reduce the size of the jack connector 20.

Also in this embodiment, the jack terminal connecting parts 27 and 28 are configured to be moved substantially parallel to the GND part 13. This configuration makes it possible to keep a constant distance between the GND part 13 and the jack terminal connecting parts 27 and 28 (signal terminals) and thereby makes it easier to match the characteristic impedance. Also in this embodiment, each pair of the jack terminal connecting parts 27 and 28 is inserted between the corresponding pair of the plug terminal connecting parts 17 and 18 when the plug connector 10 is connected with the jack connector 20. This configuration makes it possible to prevent a change in the distance between the jack terminal connecting parts 27 and 28 and the GND terminals 31 through 34 and thereby makes it easier to match the characteristic impedance.

Further in this embodiment, the GND terminals 31 through 34 are configured to reduce the stub 13*a* (an area where no current flows) on the GND part 13 of the plug connector 10. This configuration makes it possible to reduce the loss of a transmitted signal.

(Variation)

A jack connector according to a variation of the first embodiment is described below. In the first embodiment, as illustrated in FIG. 8, the GND terminals 31 through 34 of the jack connector 20 have different lengths. However, a jack connector may have a different configuration as long as it includes the jack terminals 25 and 26 with the jack terminal connecting parts 27 and 28. For example, a jack connector may include the GND terminals 330 having the same length as illustrated in FIG. 7.

Figure 18:
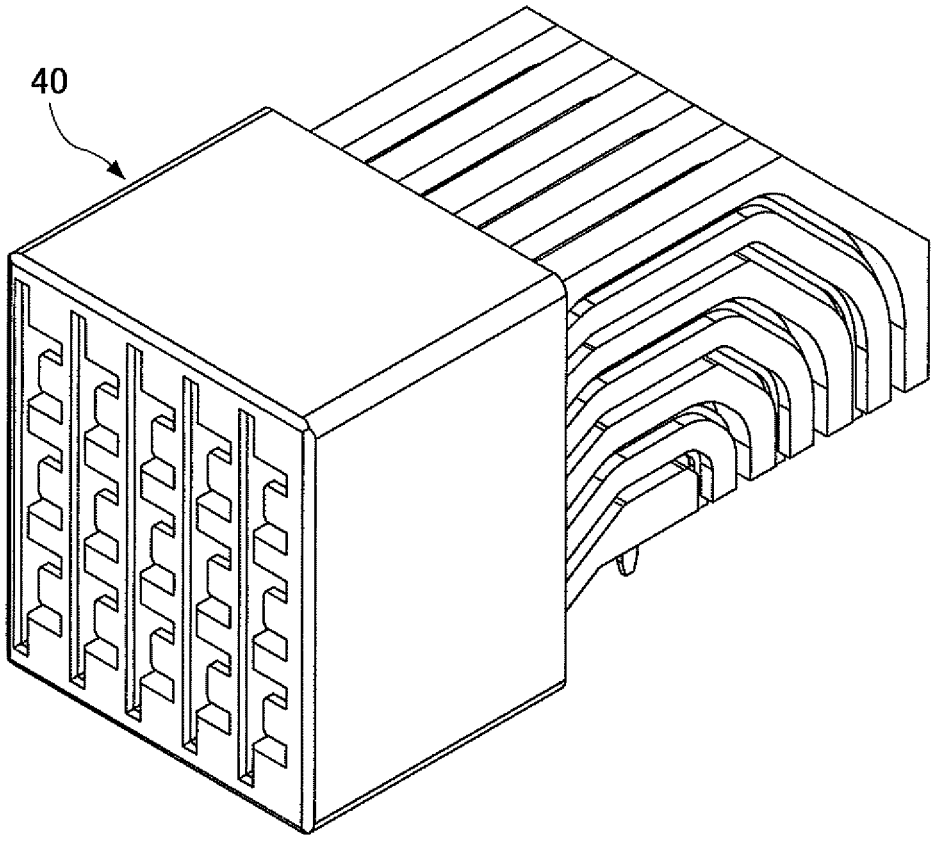
FIG. 18 is a perspective view of a jack connector according to a variation of the first embodiment.
Figure 19:
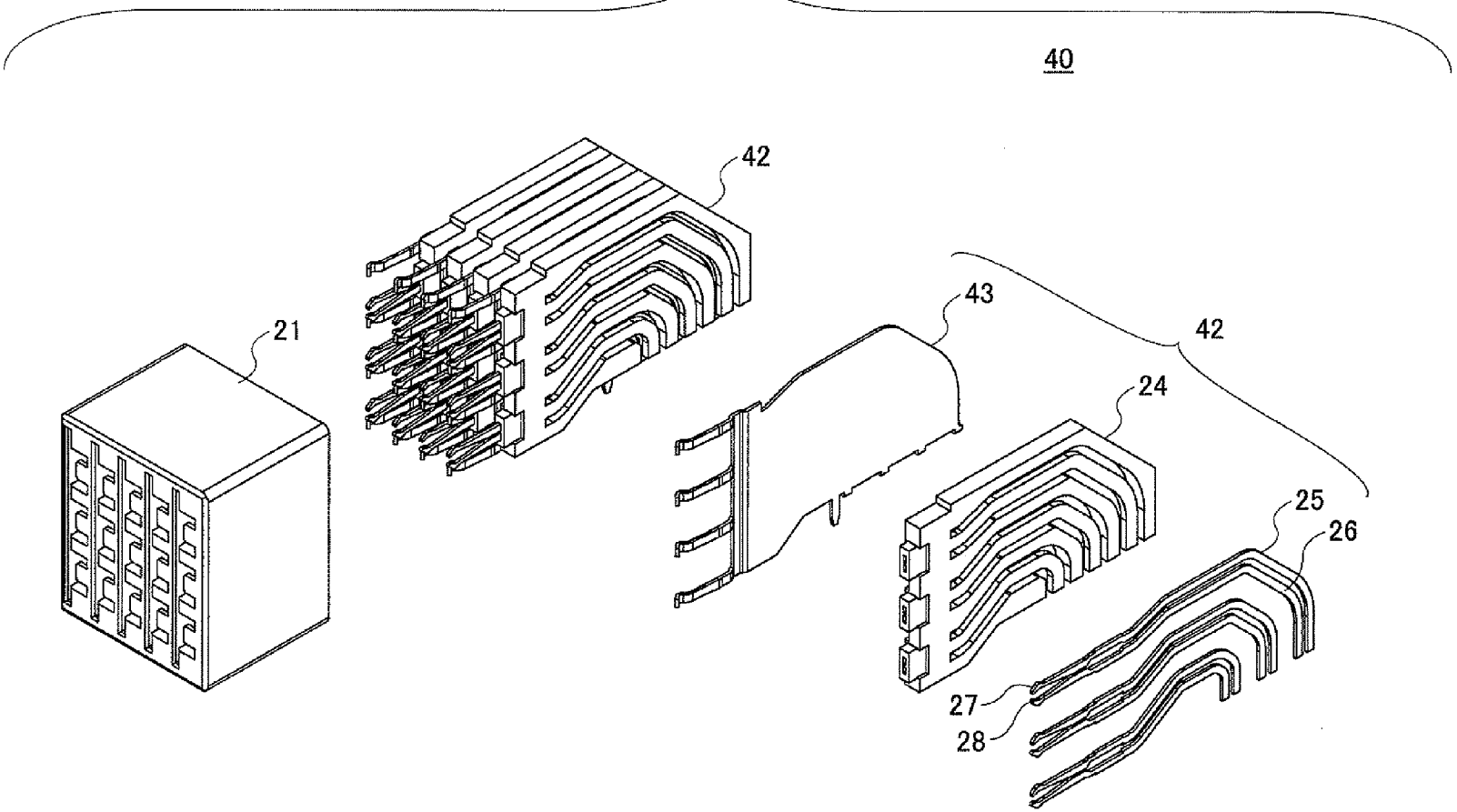
FIG. 19 is a drawing illustrating components of the jack connector according to the variation of the first embodiment.

A jack connector 40 according to a variation of the first embodiment is described below with reference to FIGS. 18 and 19. As illustrated in FIGS. 18 and 19, the jack connector 40 may include a housing 21 and multiple jack units 42. Each of the jack units may include a ground (GND) part 43 made of, for example, a metal plate; an insulating part 24 made of, for example, a resin material; and pairs of jack terminals 25 and 26 used as electrode terminals.

Figure 20:
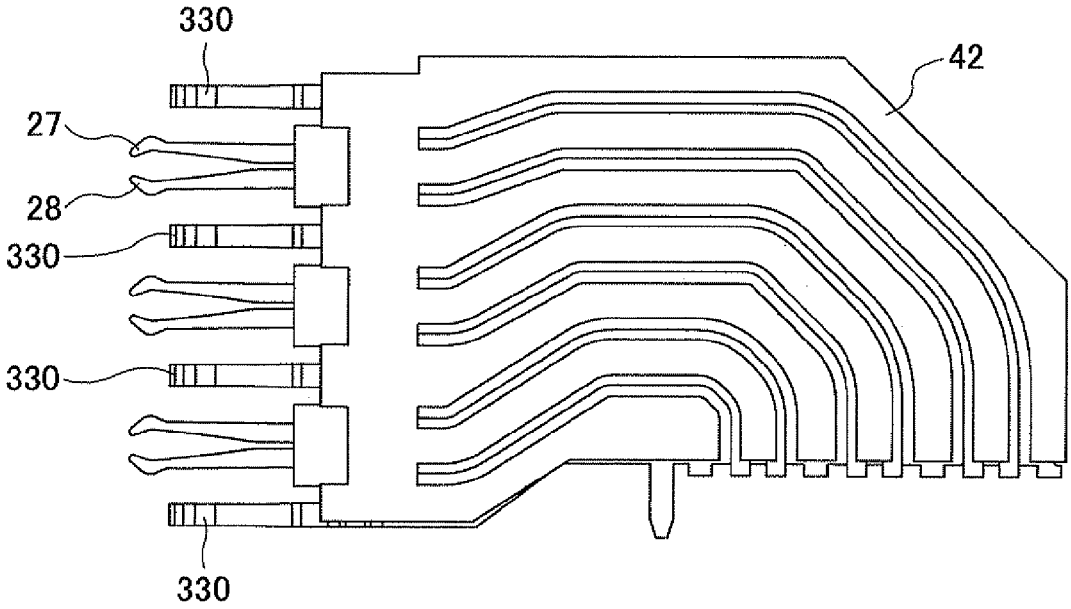
FIG. 20 is a top view of a jack unit according to the variation of the first embodiment.
Figure 21:
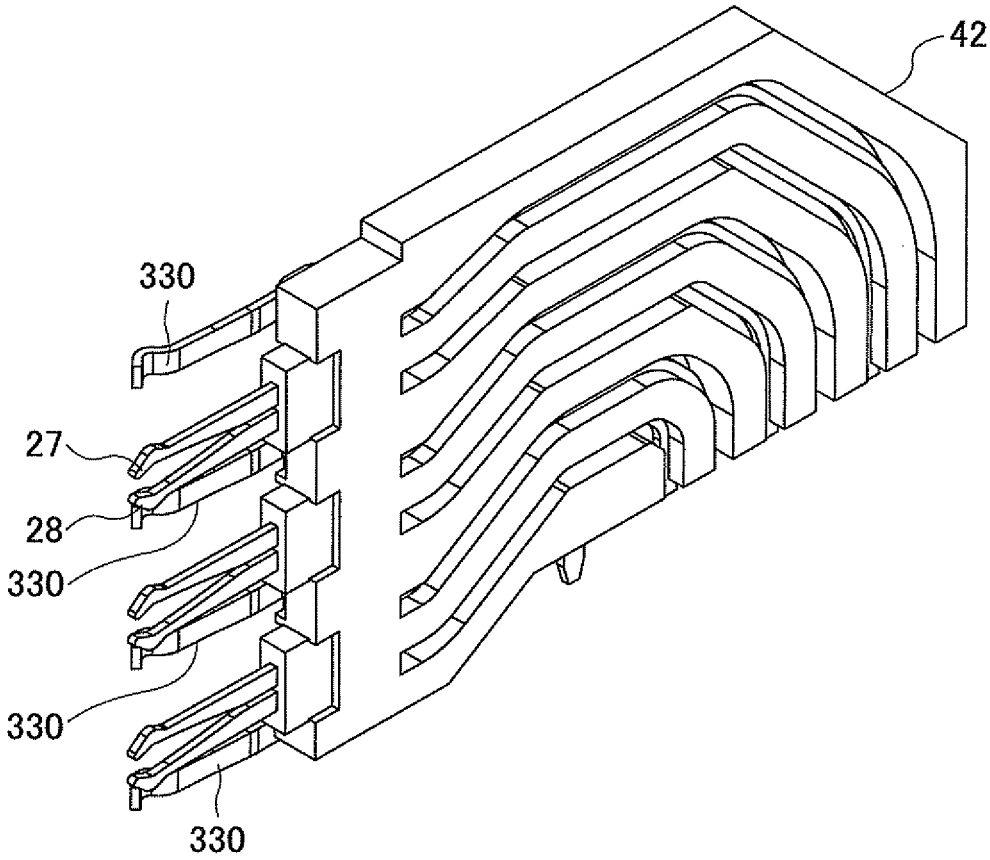
FIG. 21 is a perspective view of the jack unit according to the variation of the first embodiment.
Figure 22:
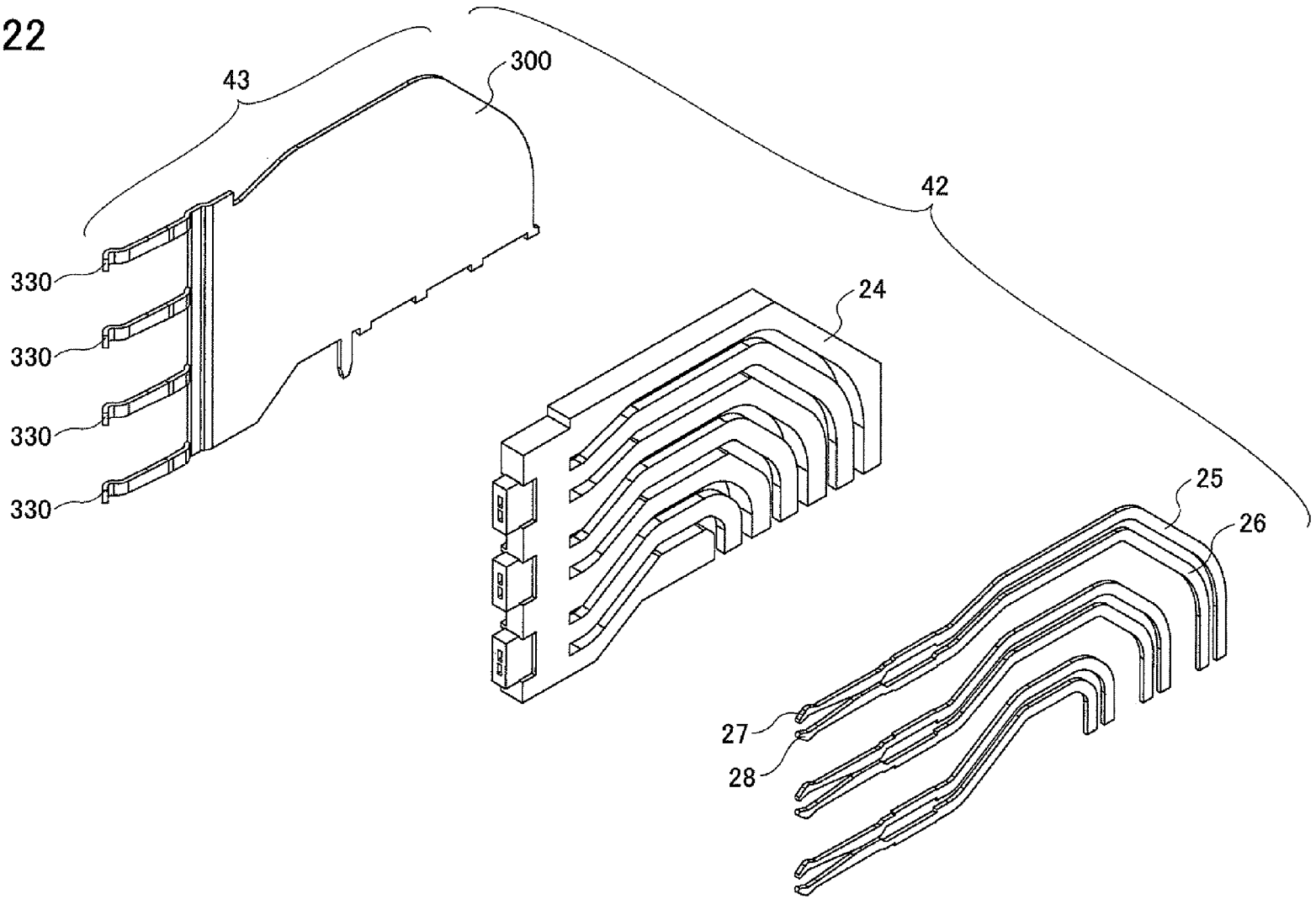
FIG. 22 is a drawing illustrating components of the jack unit according to the variation of the first embodiment.

The jack unit 42 is described in more detail with reference to FIGS. 20 through 22. The GND part 43 of the jack unit 42 may include a plate-like GND main part 300 and GND terminals 330 connected with the GND main part 300. As illustrated in FIG. 22, the GND terminals 330 have substantially the same length.

With the configuration of the jack connector 40, it is not possible to reduce a stub (an area where no current flows) formed on the GND part 13 of the plug connector 10. Still, however, the jack connector 40 provides other advantageous effects similar to those of the jack connector 20 of the first embodiment.

Second Embodiment

Figure 23:
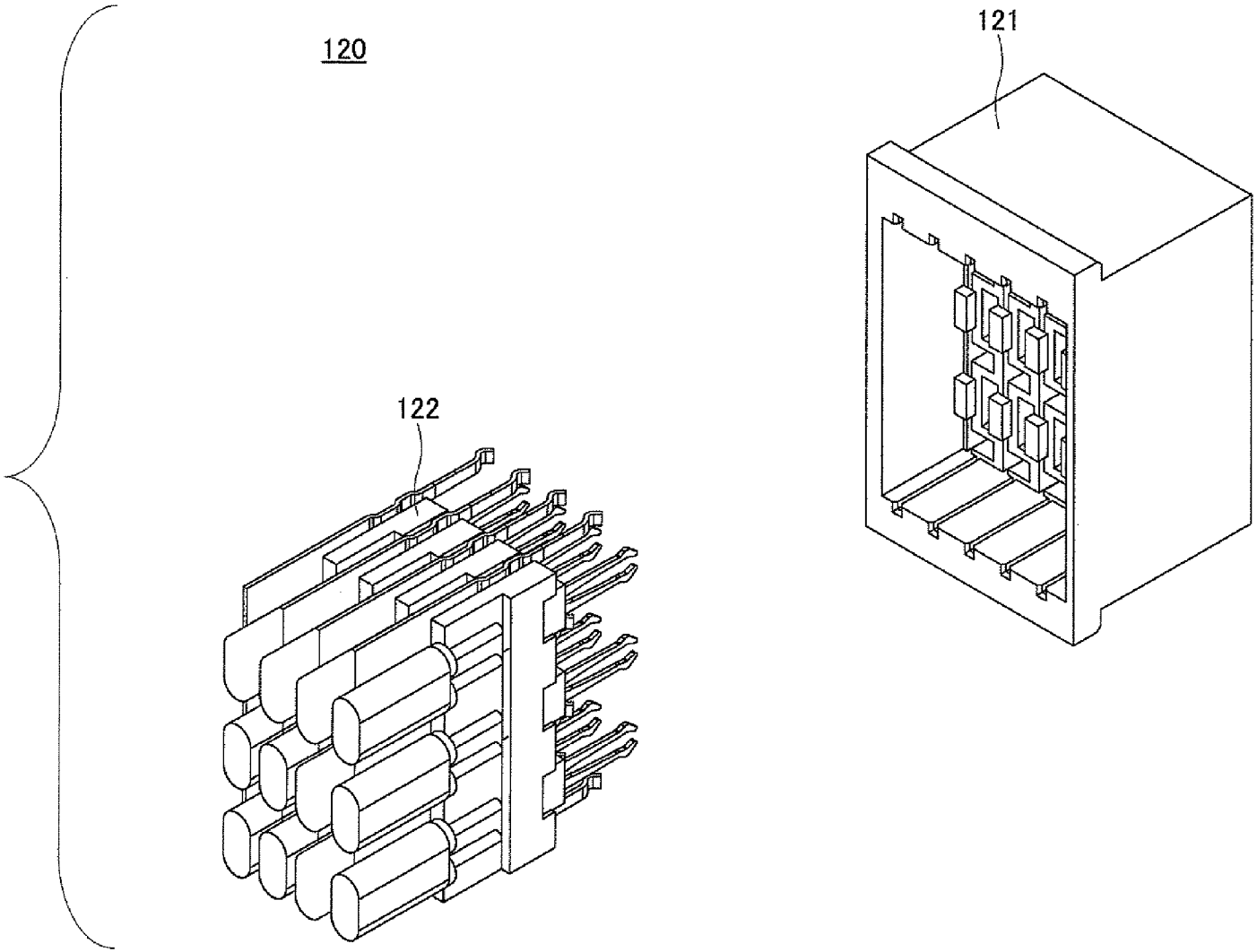
FIG. 23 is a drawing illustrating a jack connector according to a second embodiment.

Next, a second embodiment of the present invention is described. A connector of the second embodiment includes the plug connector 10 and a jack connector 120 with a configuration different from that of the jack connector 20 of the first embodiment. As illustrated in FIG. 23, the jack connector 120 includes a housing 121 and multiple jack units 122.

Figure 24:
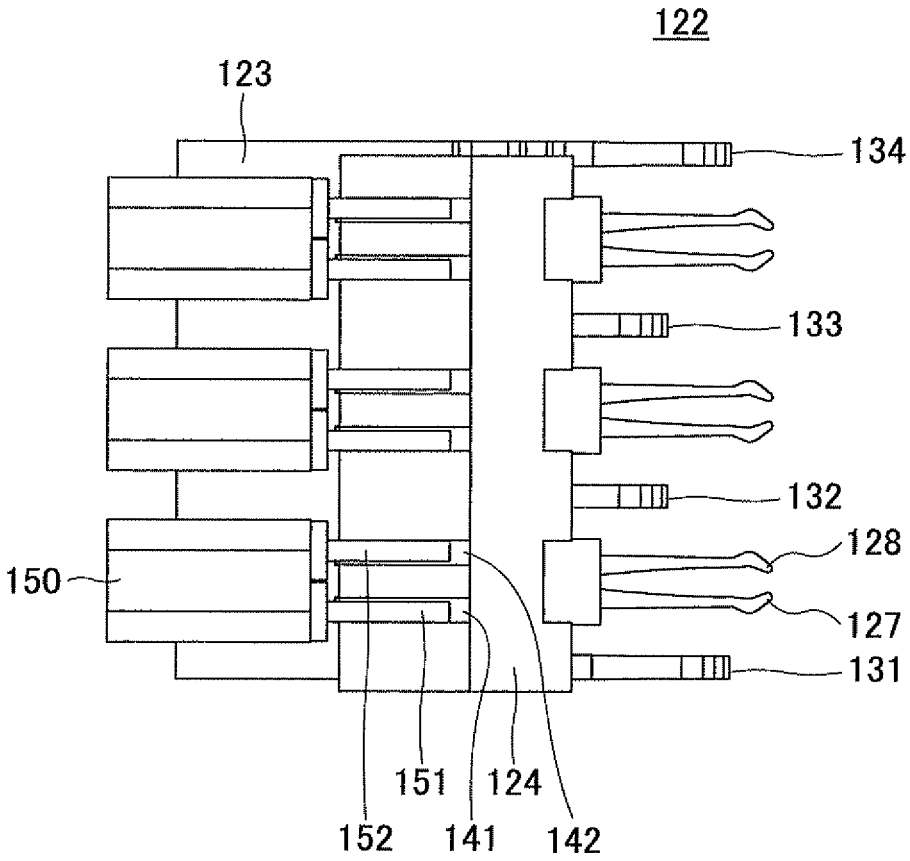
FIG. 24 is a top view of a jack unit of the second embodiment.
Figure 25:
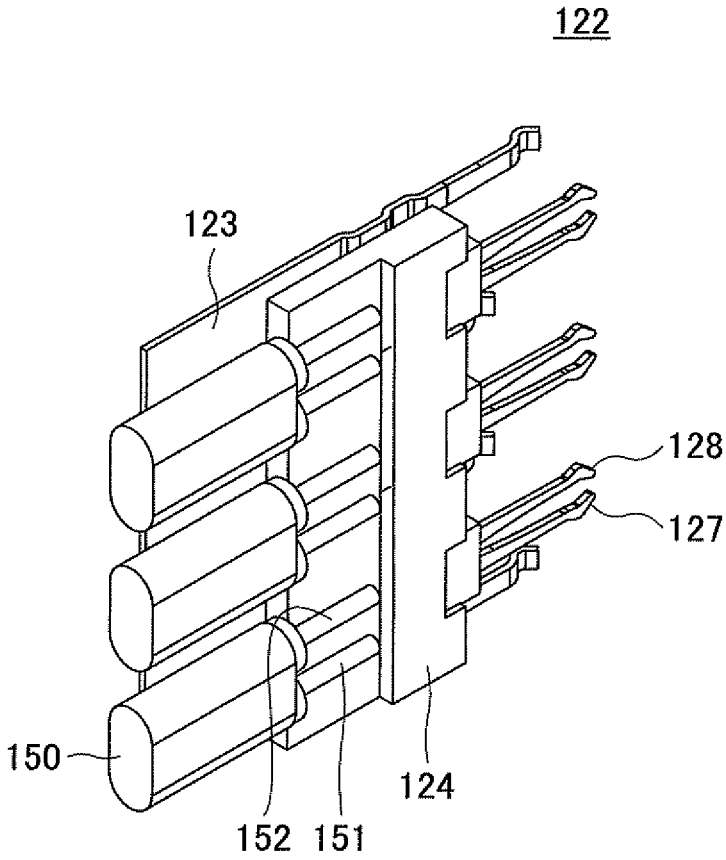
FIG. 25 is a perspective view of the jack unit of the second embodiment.
Figure 26:
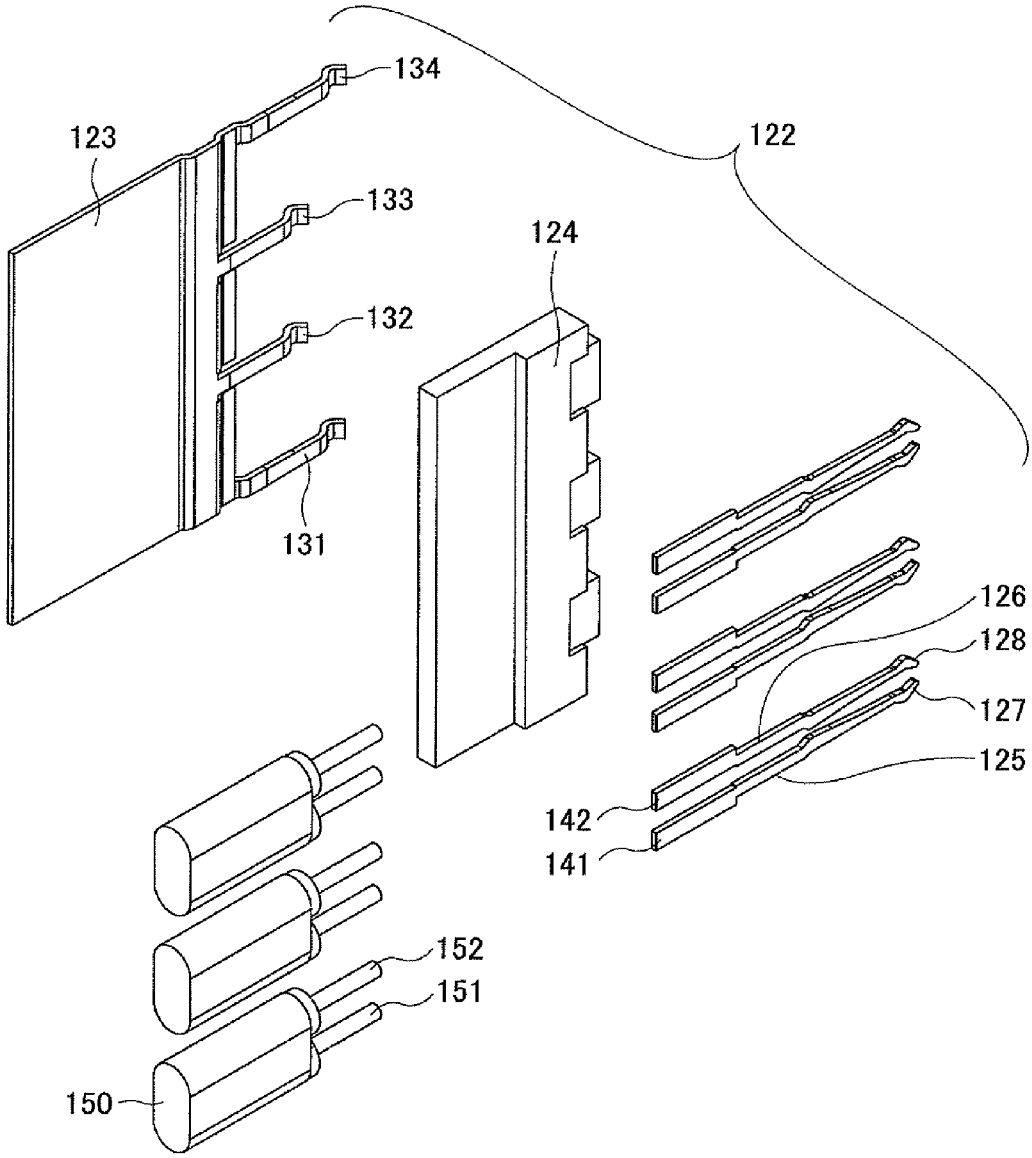
FIG. 26 is a drawing illustrating components of the jack unit of the second embodiment.

As illustrated in FIGS. 24 through 26, each of the jack units 122 may include a ground (GND) part 123 made of, for example, a metal plate; an insulating part 124 made of, for example, a resin material; and pairs of jack terminals 125 and 126 used as electrode terminals. The pairs of the jack terminals 125 and 126 may transmit different electric signals. In the example of FIGS. 24 through 26, three pairs of the jack terminals 125 and 126 are provided. The GND part 123 and the jack terminals 125 and 126 are insulated from each other by the insulating part 124. Similar to the first embodiment, bar-shaped jack terminal connecting parts 127 and 128 are formed at first ends of the jack terminals 125 and 126. The jack terminal connecting parts 127 and 128 are to be connected with the plug terminal connecting parts 17 and 18 of the plug terminals 15 and 16. Connecting terminals 141 and 142 are formed at second ends of the jack terminals 125 and 126. The connecting terminals 141 and 142 are connected with terminals 151 and 152 of cables 150. The connecting terminals 141 and 142 may be connected with the terminals 151 and 152, for example, by soldering, laser welding, or ultrasonic welding. The GND part 123 includes GND terminals 131, 132, 133, and 134. The length of the GND terminals 131 and 134 is different from the length of the GND terminals 132 and 133.

The jack terminal connecting parts 127 and 128 correspond to the jack terminal connecting parts 27 and 28 of the first embodiment, and the GND terminals 131 through 134 correspond to the GND terminals 31 through 34 of the first embodiment.

Figure 27:
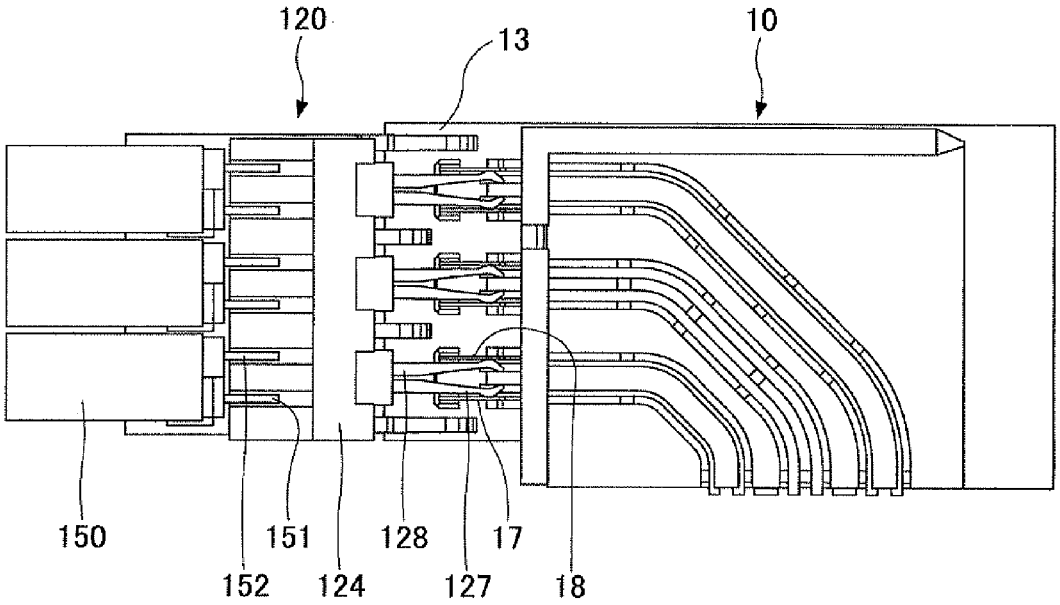
FIG. 27 is a drawing illustrating the plug connector and the jack connector of the second embodiment that are connected to each other.

FIG. 27 is a drawing illustrating the plug connector 10 and the jack connector 120 connected to each other. When the plug connector 10 and the jack connector 120 are connected to each other, a contact part of the jack terminal connecting part 127 is brought into contact with the plug terminal connecting part 17, and a contact part of the jack terminal connecting part 128 is brought into contact with the plug terminal connecting part 18.

Other configurations of the connector of the second embodiment are substantially the same as those of the first embodiment.

In the above embodiment, it is assumed that a ground potential(s) is applied to the GND parts 13, 23, 43, and 123. However, instead of a ground potential(s), a supply voltage(s) may be applied to the GND parts 13, 23, 43, and 123.

As described above, an aspect of this disclosure makes it possible to densely arrange terminals in a connector that can transmit a high-frequency signal with minimum loss and noise.

All examples and conditional language recited herein are intended for pedagogical purposes to aid the reader in understanding the invention and the concepts contributed by the inventors to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

The invention claimed is:

1. A connector, comprising:

a plug connector including a plug ground electrode, and a pair of plug terminals configured to transmit electric signals, each of the plug terminals having a plug terminal connecting part formed at a first end of each of the plug terminals; and a jack connector configured to be connected with the plug connector and including a jack ground electrode, and a pair of jack terminals configured to transmit the electric signals, each of the jack terminals having a jack terminal connecting part formed at a first end of each of the jack terminals, wherein the jack terminal connecting parts are configured to be inserted between the plug terminal connecting parts, with each jack terminal connecting part being brought into contact with a surface of a corresponding one of the plug terminal connecting parts when the jack connector is connected with the plug connector, wherein the jack ground electrode includes ground electrode terminals configured to be brought into contact with the plug ground electrode when the jack connector is connected with the plug connector, and wherein the ground electrode terminals have different lengths.

2. The connector as claimed in claim 1, wherein each of the jack terminal connecting parts includes an elastic bar-shaped part; and a contact part configured to be pressed against a corresponding one of the plug terminal connecting parts by elasticity of the bar-shaped part when the jack connector is connected with the plug connector.

3. The connector as claimed in claim 1, wherein the jack connector is configured to be connected with the plug connector by moving the jack terminal connecting parts substantially parallel to a surface of the plug ground electrode.

4. The connector as claimed in claim 1 wherein the plug connector includes plural pairs of the plug terminals arranged on a same plane; and the plural pairs of the plug terminals and the plug ground electrode constitute a plug unit.

5. The connector as claimed in claim 4, wherein the plug connector includes a plurality of the plug units.

6. The connector as claimed in claim 4, wherein the plug unit further includes an insulating part configured to insulate the plural pairs of the plug terminals from the plug ground electrode.

7. The connector as claimed in claim 1 wherein the jack connector includes plural pairs of the jack terminals arranged on a same plane; and the plural pairs of the jack terminals and the jack ground electrode constitute a jack unit.

8. The connector as claimed in claim 7, wherein the jack connector includes a plurality of the jack units.

9. The connector as claimed in claim 7, wherein the jack unit further includes an insulating part configured to insulate the plural pairs of the jack terminals from the jack ground electrode.

10. The connector as claimed in claim 1, wherein second ends of the jack terminals that are opposite to the first ends of the jack terminals are configured to be connected with a board.

11. The connector as claimed in claim 1, wherein second ends of the jack terminals that are opposite to the first ends of the jack terminals are configured to be connected with a cable.

12. The connector as claimed in claim 1, wherein the connector is configured such that a supply voltage instead of a ground potential is applied to the plug ground electrode and the jack ground electrode.

13. The connector as claimed in claim 1, wherein the plug ground electrode and the jack ground electrode are shaped like plates.

14. The connector as claimed in claim 1, wherein the plug terminal connecting parts and the jack terminal connecting parts are shaped like bars.

15. The connector as claimed in claim 1, wherein the ground electrode terminals include first ground electrode terminals having a first length and second ground electrode terminals having a second length this is different from the first length.

* * * * *